US006643862B2

(12) United States Patent
Aitken

(10) Patent No.: US 6,643,862 B2
(45) Date of Patent: Nov. 11, 2003

(54) BODY SHOWER KIT

(76) Inventor: Theodore M. Aitken, 3801 S. Flamingo Rd., Davie, FL (US) 33330

( * ) Notice: Subject to any disclaimer, the term of this patent is extended or adjusted under 35 U.S.C. 154(b) by 63 days.

(21) Appl. No.: 10/016,383

(22) Filed: Dec. 17, 2001

(65) Prior Publication Data

US 2003/0110558 A1 Jun. 19, 2003

(51) Int. Cl.[7] ..... B05B 1/18
(52) U.S. Cl. ..... 4/601; 4/615
(58) Field of Search ..... 4/567, 568, 569, 4/570, 601, 615; 239/282, 536, 550

(56) References Cited

U.S. PATENT DOCUMENTS

| | | | | | |
|---|---|---|---|---|---|
| 1,102,736 | A | * | 7/1914 | Grabau | 4/601 X |
| 3,121,235 | A | | 2/1964 | Gellman | 4/570 |
| 3,375,532 | A | | 4/1968 | Gellman | 4/570 |
| 3,971,074 | A | | 7/1976 | Yxfeldt | 4/570 |
| 3,984,879 | A | | 10/1976 | Ejchorszt | 4/601 |
| 4,554,690 | A | | 11/1985 | Knapp et al. | 4/601 |
| 5,339,469 | A | | 8/1994 | Gilles | 4/601 |
| 5,353,448 | A | * | 10/1994 | Lee | 4/567 X |
| 5,678,258 | A | | 10/1997 | Healy | 4/601 |
| 5,742,961 | A | * | 4/1998 | Casperson et al. | 4/615 |
| 6,227,456 | B1 | * | 5/2001 | Colman | 4/615 X |
| 2002/0083518 | A1 | * | 7/2002 | D'Ugo | 4/569 |

* cited by examiner

*Primary Examiner*—Robert M. Fetsuga
(74) *Attorney, Agent, or Firm*—Oltman, Flynn & Kubler

(57) ABSTRACT

For use in a conventional shower, a body shower kit providing a pair of laterally spaced lower spray heads located down from the usual shower head and connected to the latter's water supply pipe extending out from the shower wall by a conduit assembly whose geometry avoids physical interference between the kit and the control valve or valves for the usual shower head.

21 Claims, 6 Drawing Sheets

BODY SHOWER KIT

BACKGROUND OF THE INVENTION

1. Field of the Invention

This invention relates to a shower kit for ready installation in a conventional shower to provide additional shower heads located farther down and on opposite sides of the usual shower head for more complete coverage of the user's body when the water is turned on.

2. Prior Art

Various shower arrangements have been proposed heretofore for providing more complete body coverage with shower spray than is afforded by the usual single shower head located in the vicinity of, or above, the user's head.

Some of these prior arrangements (e.g., U.S. Pat. Nos. 3,121,235 and 3,375,532 to Gellmann, and Healy U.S. Pat. No. 5,678,258) are designed as attachments to the conventional shower and provide additional shower heads farther down. But these additional shower heads do not provide an entirely satisfactory overall spray pattern because they are vertically aligned with the conventional shower head at the top.

Others (e.g., Ejchorszt U.S. Pat. No. 3,984,879, and Knapp et al U.S. Pat. No. 4,554,690) do provide laterally spaced shower heads below the conventionally located shower head at the top but in much more elaborate, specialized arrangements that would require special manufacture and professional skill to install properly. The same criticism holds true for another prior art shower apparatus, Yxfeldt U.S. Pat. No. 3,971,074, which provides laterally spaced shower heads and eliminates the usual shower head at the top.

SUMMARY OF THE INVENTION

The present invention is directed to a novel kit designed as a simple "do-it-yourself" add-on or supplement to a conventional shower installation having the usual single shower head located on one wall of the shower enclosure at or above the user's head level and a water control valve arrangement, either a pair of hot and cold water valves or a single mixing valve, located farther down on the same wall.

A particular concern of this invention is to provide a novel and advantageous shower kit which can be readily installed as a supplement or add-on to such a shower without encountering physical interference with the usual water control valve or valves.

Further objects and advantages of the invention will be apparent from the following detailed description of two presently preferred embodiments thereof, shown in the accompanying drawings.

DETAILED DESCRIPTION OF THE INVENTION

Before explaining the present invention in detail it is to be understood that the invention is not limited in its application to the particular arrangements shown and described herein since the invention is capable of other embodiments. Also, the terminology used herein is for the purpose of description and not of limitation.

Figure 1:
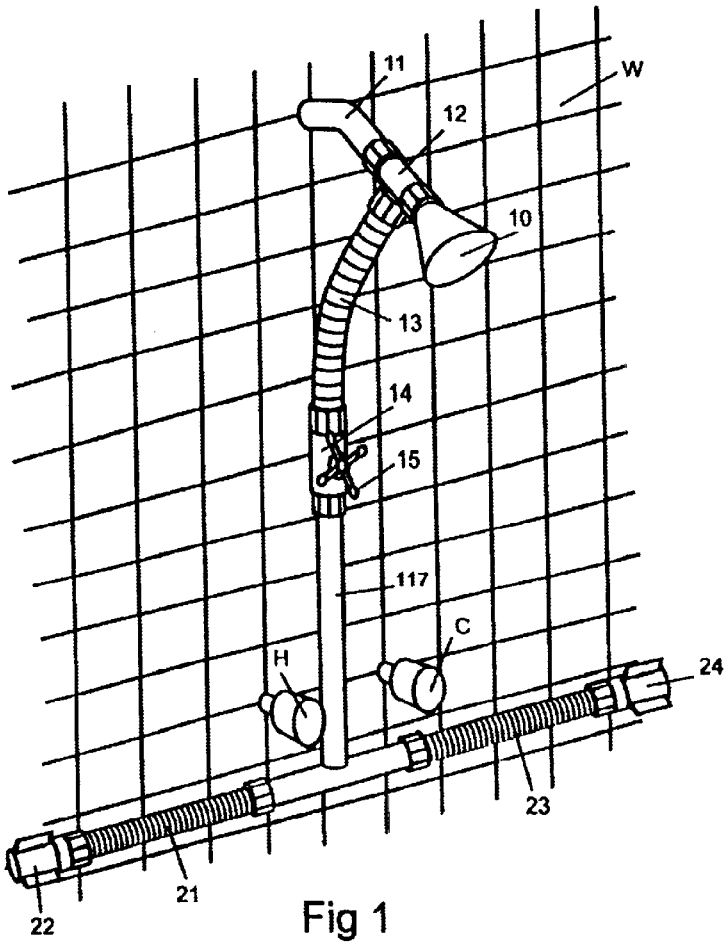
FIG. 1 is a perspective view of a body shower kit in accordance with a first embodiment of the present invention, for use in a shower having hot and cold water manual control valves.

Referring to FIG. 1, the usual shower head 10, which typically is somewhat higher than the user's head, receives water from a rigid pipe 11 that extends out and down from a wall W of the shower enclosure or compartment. Separate control valves for hot and cold water, respectively, to shower head 10 are operated by manual control knobs H and C, which extend out from the shower wall at laterally spaced locations a substantial distance below shower head 10.

Figure 2:
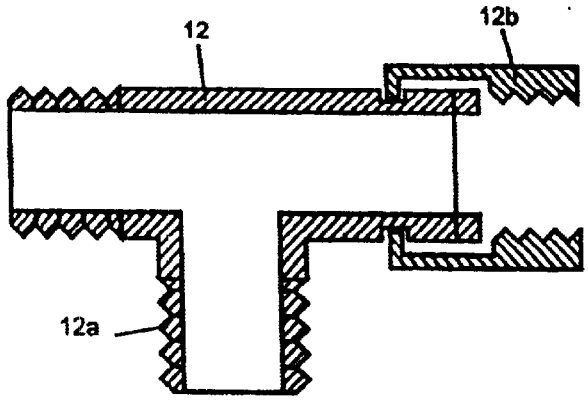
FIG. 2 is a cross-section of primary connector that position the water conduits of this kit close to the shower wall.
Figure 4:
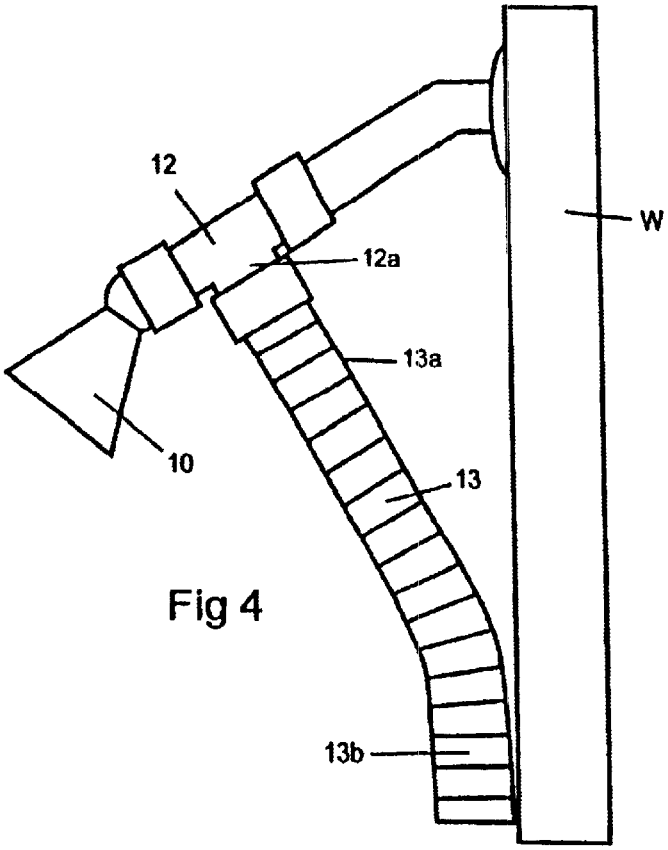
FIG. 4 is a side elevation at the T-coupling connecting the kit to the water supply pipe for the conventional shower head.
Figure 3:
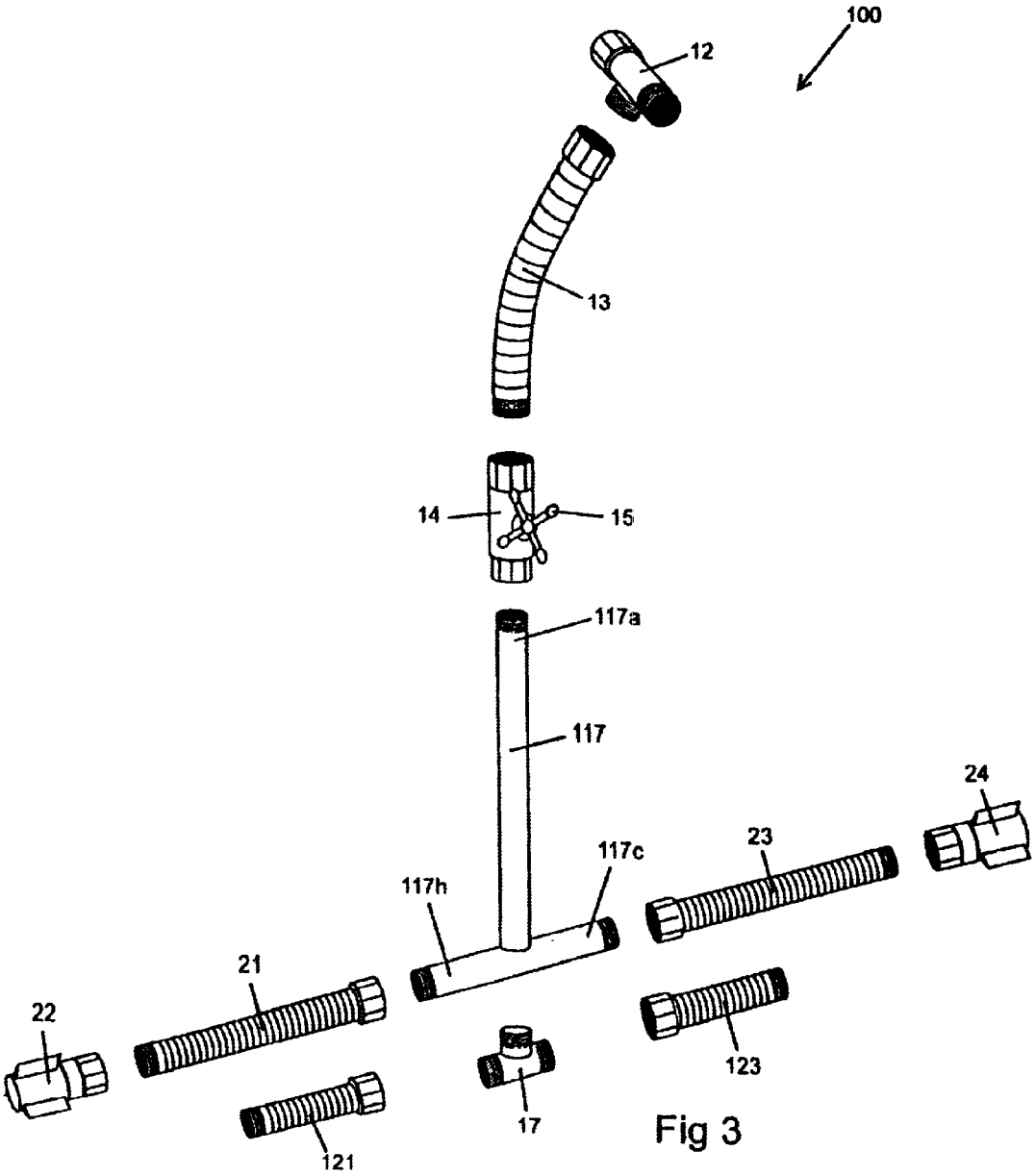
FIG. 3 is an exploded perspective view of the FIG. 1 kit, including additional parts.

In accordance with the present invention, a T-coupling 12 connects the shower head 10 to pipe 11. As shown in FIG. 2, coupling 12 has a short depending central stub 12*a* which provides a water supply passage leading to additional shower heads in the present kit. Stub 12*a* inclines downward and toward the shower wall W. The kit has a flexible conduit 13 whose externally screw-threaded upper end has a fluid-tight connection to the T-coupling stub 12*a*. Conduit 13, while flexible, is sufficiently stiff to retain the shape to which it is bent, and this shape does not change during normal use of this shower kit. The upper segment 13*a* of conduit 13 inclines downward toward the shower wall W, and at the lower end of this upper segment the conduit is bent gradually to a vertical segment 13*b* at its lower end.

A short rigid tubular connector 14 containing a control valve operated by a handle 15 is attached to the lower end of flexible conduit 13 and extends vertically down from it close to the shower wall W. The rigid inverted-T fitting 117, a conduit means, presents an upstanding middle leg 117*a* attached to the lower end of water control valve 14 and opposite, horizontal, coaxial, laterally outwardly projecting legs 117*h* and 117*c*. The fitting leg 117*h* is attached by swivel connector to flexible conduit 21 that passes under the hot water control knob H with sufficient clearance that there is no physical interference between them. Similarly, the fitting leg 117*c* is attached by swivel connector to flexible conduit 23 that passes under the cold water control knob C with sufficient clearance that there is no physical interference between them.

A flexible conduit 21 is coupled in swivel fashion to the outer end of rigid fitting 117*h* and extends horizontally from it, initially parallel to and closely spaced from the shower wall and then curving away from the shower wall. A generally tubular water spray head 22 has a swivel connection to the outer end of flexible conduit 21. The user may bend the flexible conduit to the desired shape and position to enable the water sprayed from head 22 to be directed to the desired location on the user's body.

A similar flexible conduit 23 extends from the rigid fitting 117*c* and carries an identical spray head 24 on its outer end.

The flexible conduit 21 together with the corresponding bottom leg 117*h* of rigid fitting 117 form one lower arm of the shower kit. The other lower flexible conduit 23 together with the corresponding bottom leg 117*c* of rigid fitting 117 form the opposite lower arm of the shower kit.

Each of the flexible conduits 21 and 23 in the corresponding lower arm of the shower kit can be bent manually to the shape desired by the user, and it is sufficiently stiff to retain that shape during normal use of the shower kit.

Figure 12:
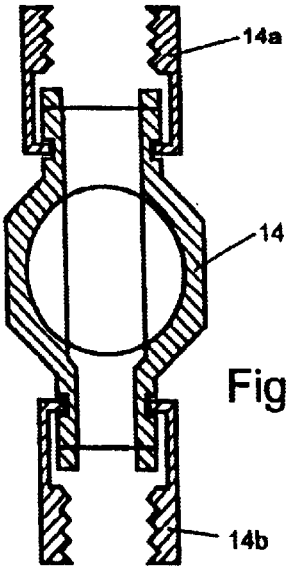
FIG. 12 is a cross section of water control valve.

FIG. 12 is a water control ball valve (14) with a swivel connector 14*a* and 14*b* at each end. The top swivel 14*a* fits to either the bottom threads of the T-coupling or primary connector 12 (FIG. 2) or to the bottom threads of flexible neck 13. The bottom swivel 14*b* connects to the top threads of either 117, 17, or 116. Each swivel is fitted with a fluid tight o-ring (not shown) and the valve is operated by a standard tap fitting.

FIG. 2 is the primary connector 12 and is made up of a T-junction fitting with the addition of a swivel 12*b* to connect to the shower pipe 11. The threads across from the swivel connect to the shower head 10 while the lower threads connect to either the top of the flexible neck 13 or to the top swivel of the water control valve 14.

FIGS. 6–9 show in detail one of the two identical lower spray heads in the kit, in this instance the spray head 24. It has a nut 30 on one end for screw-threaded attachment to the corresponding low
er flexible tube 23 At its inner end the nut 30 presents a radially inwardly protruding annular lip 31 (FIG. 8) that rotatably receives an inner tubular body 32

Figure 8:
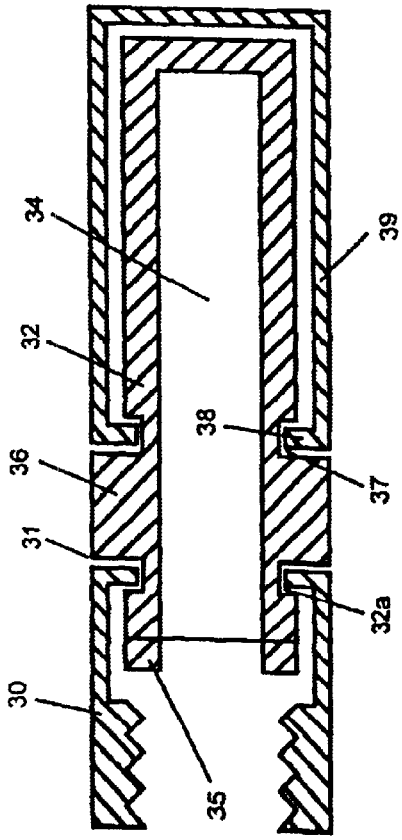
FIG. 8 is a longitudinal section through this spray head.
Figure 9:
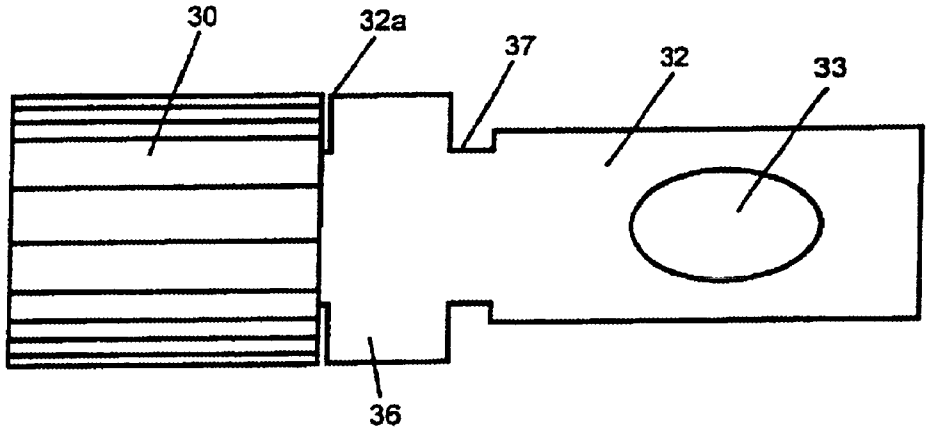
FIG. 9 is a longitudinal elevation of this spray head with its outer shell removed.

As shown in FIG. 9, the inner tubular body 32 has an oval opening 33 for passing water from its longitudinal interior cavity 34 (FIG. 8). Cavity 34 is open at the end of inner tubular member 32 where it is coupled to nut 30 and is closed at its opposite end. Seal in the form of a deformable and resilient O-ring 35 of rubber-like material is adhesively bonded to the end face of the inner tubular body 32 at the latter's open end. Next to its peripheral groove 32*a* the inner tubular body 32 has an outwardly protruding annular enlargement 36 of substantially the same diameter as the outside diameter of nut 30.

Figure 7:
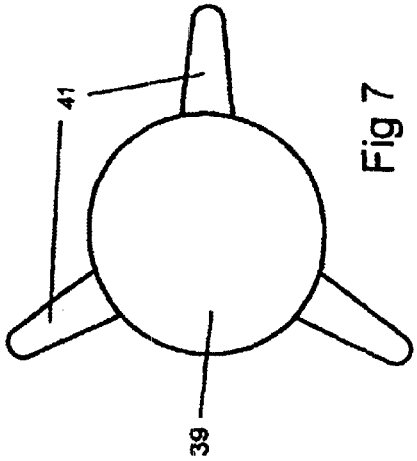
FIG. 7 is an end elevation of this spray head.
Figure 6:
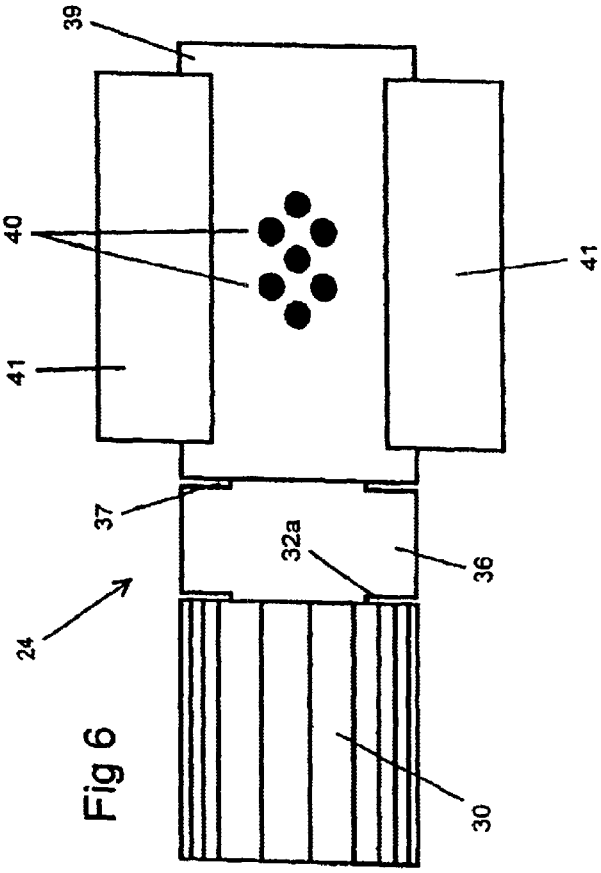
FIG. 6 is a longitudinal elevation of one of the two identical lower spray heads in this shower kit.

A peripheral groove 37 in the inner tubular body rotatably receives a radially inwardly protruding lip 38 on one end of an outer tubular body or sleeve 39 of the spray head. The opposite end of this sleeve is closed and extends across the closed end of the inner tubular body 32. The sleeve or outer tubular body 39 on one side presents a plurality of water spray holes 40 (FIG. 6) which receive water via the opening 33 in inner tubular member 32. There are two other sets of spray holes in between fins 41. One set may be four larger holes, and the third set may be a vertical slit. As shown in FIG. 7, the outer sleeve 39 of the spray head carries three circumferentially spaced radial fins 41 which the user may grasp to swivel the outer sleeve on the inner tubular member 32 to select the pattern of the water spray coming out of the openings 40 in the outer sleeve 39. The inner tubular member can be aimed to aim the water holes. To accomplish this the swivel is loosened, the inner tubular member is rotated and then the swivel is re-tightened.

With this arrangement, the user of the complete shower installation shown in FIG. 1 has three shower heads: the usual one (10) located in the general vicinity of the user's head, and the swiveled lower heads 22 and 24 of the present shower kit located farther down on opposite sides of the user's body when in use. This shower kit can be installed on a conventional shower by hand without hand tools, and no special skill or experience is required to complete the installation successfully. Despite its simplicity, the complete installation provides a highly effective way of spraying water all over the user's body.

Figure 5:
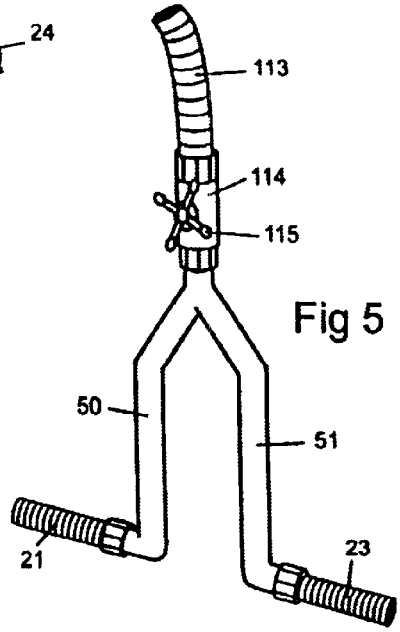
FIG. 5 is a partial perspective of a body shower kit in accordance with a second embodiment of this invention, for use in a shower having a single manual mixing valve.

FIG. 5 shows an alternative conduit sub-assembly for use on a shower having a single mixing valve instead of separate hot and cold water valves as in the first embodiment. Elements in FIG. 5 which correspond to those in FIGS. 1–4 are given the same reference numerals plus 100, so the detailed description need not be repeated for these corresponding elements.

The conduit means coming down from the valved connector 114 is bifurcated, forming an inverted Y whose opposite legs 50 and 51 extend down on opposite sides of the mixing valve's control knob M with sufficient clearance above and on each side to avoid physical interference with the control knob. The lower end of leg 50 bends to a right angle that leads to the lower flexible conduit 21 on that side of the mixing valve. Similarly, the lower end of the other leg 51 of the Y bends to a right angle to the other lower flexible conduit 22. In other respects the kit of FIG. 1 is essentially identical to the kit of FIG. 1.

Figure 10:
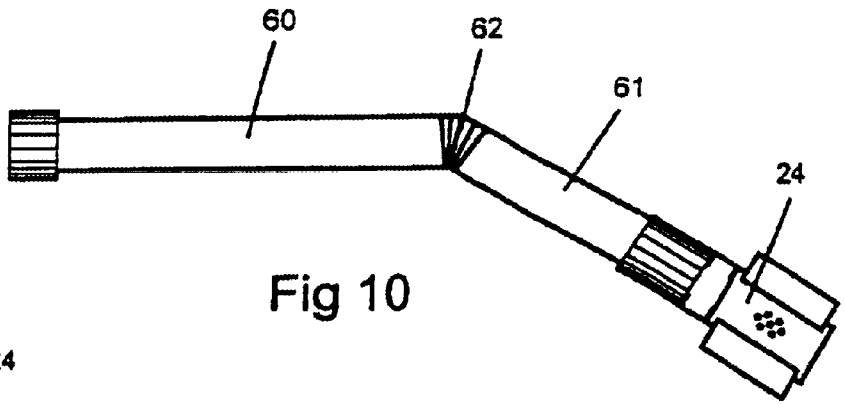
FIG. 10 is a longitudinal elevation of one of the lower arms of the shower kit in accordance with another embodiment of the invention.

In either the inverted T or the inverted Y form of the shower kit each lower arm can have the flexible conduit 21 or 23 replaced by an arrangement as shown in FIG. 10, Here the lower arm for spray head 24 comprises a pair of rigid pipes 60 and 61 connected to each other by a short segment of flexible conduit 62, which may be bent to position the spray head as desired by each user. The flexible conduit 62 is stiff enough to retain the shape to which it has been bent throughout normal use of the shower kit.

Figure 11:
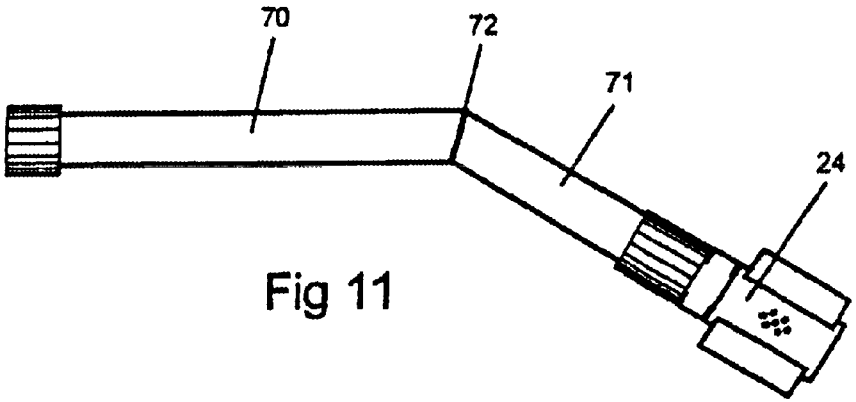
FIG. 11 is a similar view of yet another embodiment.

A further alternative construction of each lower arm of the shower kit is shown in FIG. 11. Here rigid piped 70 and 71 are rigidly connected end-to-end, such as by soldering at 72, so that the pipe 71 holding the spray head 24 extends out from the shower wall at an acute angle. In this embodiment the only adjustability is in the swivel construction of the spray head itself.

A preferred variation of the shower kit 100 has three additional elements which serve as alternatives to some of the previously described elements so that several variations of the resulting shower assembly 110 can be constructed to concentrate shower spray specifically onto certain parts of the user body. A single shortened rigid fitting 17 is provided with kit 100 having the shortened dimensions of rigid fitting 117. As an alternative to lateral flexible conduits 21 and 23, short lateral flexible conduits 121 and 123 are provided with the kit as well.

Figure 13:
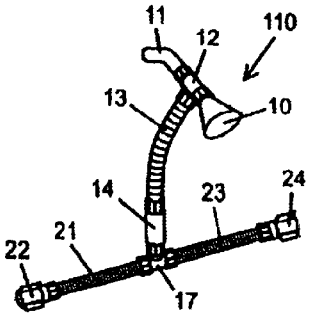
FIG. 13 is a perspective view of the kit in which selected variable elements including the rigid fitting, the lateral flexible conduits and the upright flexible conduit are combined with the above-listed constant elements to construct a flexible wide center back spraying assembly.
Figure 16:
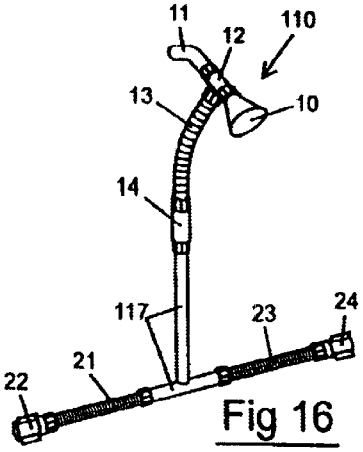
FIG. 16 is a perspective view of the kit in which variable elements including the elongated rigid fitting, the upright flexible conduit and the lateral flexible conduits are selected to construct a standard layout spraying assembly.
Figure 19:
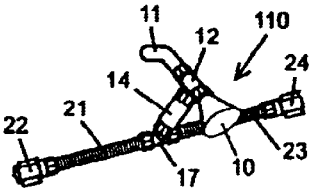
FIG. 19 is a perspective view of the kit in which variable elements including the rigid fitting and the lateral flexible conduits are selected to construct a flexible wide shoulder and neck spraying assembly.
Figure 14:
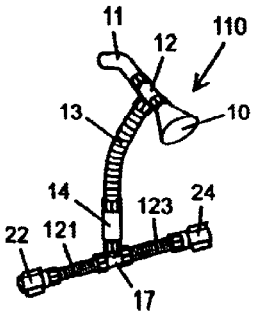
FIG. 14 is a perspective view of the kit in which variable elements including the rigid fitting, the upright flexible conduit and the short lateral flexible conduits are selected to construct a closely spaced flexible back spraying assembly.
Figure 17:
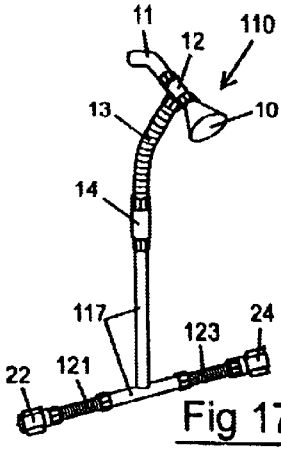
FIG. 17 is a perspective view of the kit in which variable elements including the elongated rigid fitting, the upright flexible conduit and the short lateral flexible conduits are selected to construct a closely spaced flexible side and back spraying assembly.
Figure 20:
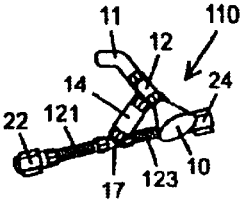
FIG. 20 is a perspective view of the kit in which variable elements including the rigid fitting and the short lateral flexible conduits are selected to construct a flexible close shoulder and neck spraying assembly.
Figure 15:
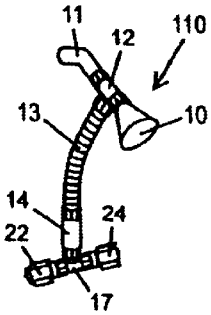
FIG. 15 is a perspective view of the kit in which variable elements including the rigid fitting and the upright flexible conduit are selected to construct a center back spraying assembly.
Figure 18:
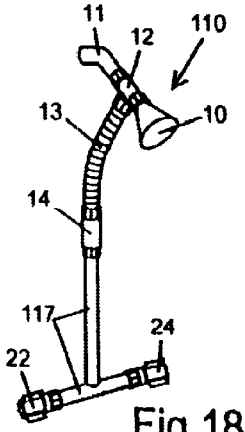
FIG. 18 is a perspective view of the kit in which variable elements including the elongated rigid fitting and the upright flexible conduit are selected to construct a lower back spraying assembly.
Figure 21:
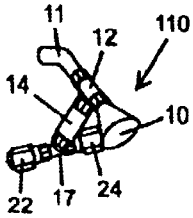
FIG. 21 is a perspective view of the kit in which variable elements including only the rigid fitting is selected to construct a shoulder and neck spraying assembly.

With the addition of these alternative kit elements, at least nine shower assembly 110 variations can be constructed from a combination of constant elements including T-coupling 12, spray heads 22 and 24, connector valve 14 with handle 15, and optionally certain selected variable elements including upright flexible conduit 13, lateral flexible conduits 21 and 23, short lateral flexible conduits 121 and 123, rigid fitting 17 and the elongated rigid fitting 117. These assembly 110 variations are constructed to deliver water onto specific selected areas of the user body, as illustrated in FIGS. 13–21. In a first example, the variable elements fitting 17, lateral flexible conduits 21 and 23 and upright flexible conduit 13 can be combined with the constant elements as shown in FIG. 13 to construct a flexible wide center back spraying assembly 110. The assembly 110 of FIG. 14 incorporates fitting 17, upright flexible conduits 13 and short lateral flexible conduits 121 and 123 as variable elements for closely spaced back spraying. The assembly 110 of FIG. 15 incorporates fitting 17 and upright flexible conduit 13 as the variable elements for center back spraying. The assembly 110 of FIG. 16 incorporates elongated rigid fitting 117, upright flexible conduit 13 and lateral flexible conduits 21 and 23 as the variable elements for standard layout spraying. The assembly 10 of FIG. 17 incorporates elongated rigid fitting 117, upright flexible conduit 13 and short lateral flexible conduits 121 and 123 as the variable elements for flexible side and back spraying. The assembly 110 of FIG. 18 incorporates elongated rigid fitting 117 and upright flexible conduit 13 as the variable elements for lower back spraying. The assembly 110 of FIG. 19 incorporates rigid fitting 17 and lateral flexible conduits 21 and 23 as the variable elements for flexible wide shoulder and neck spraying. The assembly 110 of FIG. 20 incorporates rigid fitting 17 and short lateral flexible conduits 121 and 123 as the variable elements for flexible close shoulder and neck spraying. The assembly 110 of FIG. 21 incorporates only the rigid fitting 17 as the variable element for shoulder and neck spraying.

I claim:

1. A body shower kit for use in a shower installation having an upstanding wall, a shower head spaced in front of said wall, a water supply pipe for said shower head extending out from said wall to said shower head, and a manual valve control means for controlling the water supply to said pipe and extending in front of said wall below said pipe, comprising:

a T-coupling located between said pipe and said shower bead having a dependency leg;

a flexible conduit connected to said leg of said coupling, a swivel connector attaching said leg to said flexible conduit to pass water therefrom, said flexible conduit extending rearward toward said wall and downward from said coupling;

a pair of lower shower heads positioned downward from said coupling and located laterally outward from said valve control means on opposite sides thereof; and and conduit means connecting said flexible conduit to both said lower shower heads and extending with a clearance past said valve control means.

2. The improvement of claim 1, further comprising a pair of lower shower heads positioned laterally outward from said front shower head.

3. A body shower kit for use in a shower installation having an upstanding wall, a shower head spaced in front of said wall, a water supply pipe for said shower head extending out from said wall to said shower head, and a manual valve control means which has hot and cold water controls laterally spaced apart on said wall for controlling the water supply to said pipe and extending in front of said wall below said pipe, comprising:

a coupling located between said pipe and said shower head;

a conduit operatively connected to said coupling to pass water therefrom, said conduit extending substantially downward from said coupling;

a pair of lower shower heads positioned downward from said coupling and located laterally outward from said valve control means on opposite sides thereof;

and conduit means connecting said conduit to both said lower shower heads and extending with a clearance past said valve control means; and wherein said conduit means presents an inverted T shape with a vertical leg passing between said hot and cold water controls and a pair of horizontal lower arms extending laterally outward in opposite directions from the lower end of said vertical leg and respectively passing under said hot and cold water controls, and said lower shower beads arc on the outer ends of said lower arms.

4. Apparatus according to claim 3, wherein said coupling comprises a T-coupling having a dependency leg to which said conduit is operatively connected.

5. The improvement of claim 3, wherein each of said lower arms includes a manually bendable flexible conduit.

6. A body shower kit for use in a shower installation having an upstanding wall, a shower head spaced in front of said wall, a water supply pipe for said shower head extending out from said wall to said shower head, and a manual valve control means which has a single mixing valve control on said wall for controlling the water supply to said pipe and extending in front of said wall below said pipe, comprising:

a coupling located between said pipe and said shower head;

a conduit operatively connected to said coupling to pass water therefrom, said conduit extending substantially downward from said coupling;

a pair of lower shower heads positioned downward from said coupling and located laterally outward from said valve control means on opposite sides thereof;

and conduit means connecting said flexible conduit to both said lower shower heads and extending with a clearance past said valve control means; and wherein said conduit means presents an inverted Y shape extending over the top of said single control and passing down on opposite sides thereof and a pair of lower arms extending laterally outward in opposite directions, and said lower shower heads are on the outer ends of said lower arms.

7. Apparatus according to claim 6, wherein said coupling comprises a T-coupling having a dependency leg to which said conduit is operatively connected.

8. The improvement of claim 6, wherein each of said lower arms includes a manually bendable flexible conduit.

9. A body shower kit for use in a shower installation having an upstanding wall, a shower head spaced in front of said wall, a water supply pipe for said shower head extending out from said wall to said shower head, and a manual valve control means which has hot and cold water controls laterally spaced apart on said wall for controlling the water supply to said pipe and extending in front of said wall below said pipe, comprising:

a coupling located between said pipe and said shower head;

a flexible conduit operatively connected to said coupling to pass water therefrom, said flexible conduit extending rearward toward said wall and downward from said coupling;

a pair of lower shower heads positioned downward from said coupling and located laterally outward from said valve control means on opposite sides thereof;

and conduit means connecting said flexible conduit to both said lower shower heads and extending with a clearance past said valve control means; and wherein said conduit means presents an inverted T shape with a vertical leg passing between said hot and cold water controls and a pair of horizontal lower arms extending laterally outward in opposite directions from the lower end of said vertical leg and respectively passing under said hot and cold water controls, and said lower shower heads are on the outer ends of said lower arms.

10. Apparatus according to claim 9 wherein each of said lower shower heads is adjustable to select the pattern of the water spray therefrom.

11. Apparatus according to claim 10, and further comprising a manual valve in said conduit means controlling the supply of water to said lower shower heads.

12. Apparatus according to claim 10 wherein each of said lower arms includes a manually bendable flexible conduit.

13. Apparatus according to claim 9, and further comprising a manual valve in said conduit means controlling the supply of water to said lower shower heads.

14. Apparatus according to claim 9 wherein each of said lower arms includes a manually bendable flexible conduit.

15. A body shower kit for use in a shower installation having an upstanding wall, a shower head spaced in front of said wall, a water supply pipe for said shower head extending out from said wall to said shower head, and a manual valve control means which has a single mixing valve control on said wall for controlling the water supply to said pipe and extending in front of said wall below said pipe, comprising:

a coupling located between said pipe and said shower head;

a flexible conduit operatively connected to said coupling to pass water therefrom, said flexible conduit extending rearward toward said wail and downward from said coupling;

a pair of lower shower heads positioned downward from said coupling and located laterally outward from said valve control means on opposite sides thereof;

and conduit means connecting said flexible conduit to both said lower shower heads and extending with a clearance past said valve control means; and wherein said conduit means presents an inverted Y shape extending over the top of said single control and passing down on opposite sides thereof and a pair of lower arms extending laterally outward in opposite directions, and said lower shower heads are on the outer ends of said lower arms.

16. Apparatus according to claim 15 wherein each of said lower shower heads is adjustable to select the pattern of the water spray therefrom.

17. Apparatus according to claim 16, and further comprising a manual valve in said conduit means controlling the supply of water to said lower shower heads.

18. Apparatus according to claim 16 wherein each of said lower arms includes a manually bendable flexible conduit.

19. Apparatus according to claim 15, and further comprising a manual valve in said conduit means controlling the supply of water to said lower shower heads.

20. Apparatus according to claim 15 wherein each of said lower arms includes a manually bendable flexible conduit.

21. Apparatus according to claim 9 or 15 wherein each of said lower shower heads is adjustable to select the direction of the water spray therefrom.

* * * * *